US007007590B2

(12) United States Patent
Trümper et al.

(10) Patent No.: US 7,007,590 B2
(45) Date of Patent: Mar. 7, 2006

(54) DEVICE WITH AT LEAST ONE EXTENSION ARM OR SUPPORT ARM FOR MULTI-LINKED CRANE SHAPED EXTENSION ARMS, CONCRETE SPREADER COLUMNS AND SIMILAR

(75) Inventors: Siegfried Trümper, Dortmund (DE); Horst Heckmann, Sprockhovel (DE)

(73) Assignee: Schwing GmbH, Herne (DE)

( * ) Notice: Subject to any disclaimer, the term of this patent is extended or adjusted under 35 U.S.C. 154(b) by 218 days.

(21) Appl. No.: 10/451,563

(22) PCT Filed: Dec. 21, 2001

(86) PCT No.: PCT/EP01/15222

§ 371 (c)(1),
(2), (4) Date: Dec. 8, 2003

(87) PCT Pub. No.: WO02/052115

PCT Pub. Date: Jul. 4, 2002

(65) Prior Publication Data

US 2004/0151544 A1 Aug. 5, 2004

(30) Foreign Application Priority Data

Dec. 22, 2000 (DE) ..... 100 64 365

(51) Int. Cl.
*F15B 15/14* (2006.01)

(52) U.S. Cl. ..... 92/109; 92/260; 29/888.042

(58) Field of Classification Search ..... 29/888.042; 92/109, 169.4, 260
See application file for complete search history.

(56) References Cited

U.S. PATENT DOCUMENTS

| | | | | |
|---|---|---|---|---|
| 3,147,671 A * | 9/1964 | Geyer | ..... | 92/109 |
| 4,003,297 A * | 1/1977 | Mott | ..... | 92/109 |
| 4,058,178 A * | 11/1977 | Shinohara et al. | ..... | 92/118 |

FOREIGN PATENT DOCUMENTS

| | | |
|---|---|---|
| DE | 884880 | 7/1953 |
| FR | 2224659 | 10/1974 |
| GB | 2140362 | 11/1984 |

* cited by examiner

*Primary Examiner*—Thomas E. Lazo
(74) *Attorney, Agent, or Firm*—Price, Heneveld, Cooper, DeWitt & Litton

(57) ABSTRACT

The invention relates to a device with at least one extension arm or support arm for multi-linked crane shaped extension arms, concrete spreader columns and similar, comprising at least one hydraulic differential cylinder for actuating a support arm. The cylinder comprises a hollow piston rod which has a tubular segment and two end pieces arranged on the ends of said segment, whereby at least one of the end pieces is welded on to the segment thereof. The welded joint is machined and the root of the weld is eliminated. At least one of the end pieces comprises a through opening which enables tool access in order to machine the hollow cavity of the hollow piston rod.

13 Claims, 4 Drawing Sheets

DEVICE WITH AT LEAST ONE EXTENSION ARM OR SUPPORT ARM FOR MULTI-LINKED CRANE SHAPED EXTENSION ARMS, CONCRETE SPREADER COLUMNS AND SIMILAR

CROSS-REFERENCE TO RELATED APPLICATION

This application is the National Phase of International Application No. PCT/EP01/15222, filed in Germany on Dec. 22, 2001 designating the United States of America, which claims priority to German Patent Application No. 100 64 365.5, filed on Dec. 22, 2000.

BACKGROUND OF THE INVENTION

The present invention generally relates to a device with at least one support arm.

Concrete spreader columns made up of column arms that are linked together by means of articulated joints and, with a view to saving space, are capable of being folded and subsequently being swung out or extended for operating purposes and make use, especially for the lowest extension and/or support arm or arms, of relatively large differential hydraulic cylinders. These cylinders are employed as a drive for the lifting, lowering and, where appropriate, for the telescoping of an extension arm. The hydraulic cylinders used for this purpose have stroke lengths of up to 2.5 m and over. It is practically self-evident that these hydraulic cylinders have to be designed sufficiently large and dimensionally stable to render them capable of coping with the forces that come into play when the whole of the column is operated. More particularly, when extending and/or moving the arms. Such multi-linked column structures involve considerable weight.

In order to reduce this weight, particular attention must be paid to minimizing the masses that have to be moved, not least, by means of the lowest hydraulic cylinder. It is therefore desirable for extension arms of this type to be made as light as possible while still being able to cope with these large forces during operation.

It is thus the task of the invention to further develop a device of the described kind in such a manner as to render possible, given skillful design, a reduction of the weight of the device via the differential hydraulic cylinders that are to be used as drives for the extension arms, or support arms, of multi-linked crane-shaped extension arms, concrete spreader columns and the like. It is thus designed with a view to saving weight.

SUMMARY OF THE INVENTION

The present invention concerns a device with at least one extension arm or support arm for crane-shaped extension arms, concrete spreader columns, lifting platforms, manipulators and similar multi-linked working systems. The invention further concerns a method for the production of such a device, especially a hydraulic differential cylinder used for the device. More particularly, the invention concerns the construction of a concrete spreader column for a concrete pump, be it mobile or in a fixed position, the column (mast) consisting of several sections that can be folded and possibly telescoped, where the operation of the column arms is effected especially by means of hydraulic differential cylinders.

According to the invention, this reduction in weight is accomplished by means of the features of the device as set out in claims 1 and 9, whereas the process engineering aspects for the fabrication of such a device are determined by claim 6.

In accordance with the invention, the hydraulic differential cylinders are already turned into lightweight structures by virtue of the fact that the piston rod is designed as a hollow component. The hollow piston rod comprises this tubular segment and end pieces arranged at the ends of the tubular segment.

According to the invention, the tubular segment and at least one of the end pieces is welded on. Accessibility for the machining tool is assured by the fact that at least one of the end pieces is provided with an opening by means of which the cutting tool and possibly a smoothing tool can be introduced into the interior of the piston rod to carry out the necessary work there. Of course, the invention can also be applied quite generally to hydraulic differential cylinders that are used independently of the application cases mentioned hereinabove, though the preferred field of application is constituted by crane-shaped extension arms, concrete spreader columns and similar manipulators.

These and other features, advantages, and objects of the present invention will be further understood and appreciated by those skilled in the art by reference to the following specification, claims, and appended drawings.

BRIEF DESCRIPTION OF THE DRAWINGS

Some preferred embodiments of the invention will now be described with reference to the drawing, of which

DESCRIPTION OF THE PREFERRED EMBODIMENTS

Figure 1:
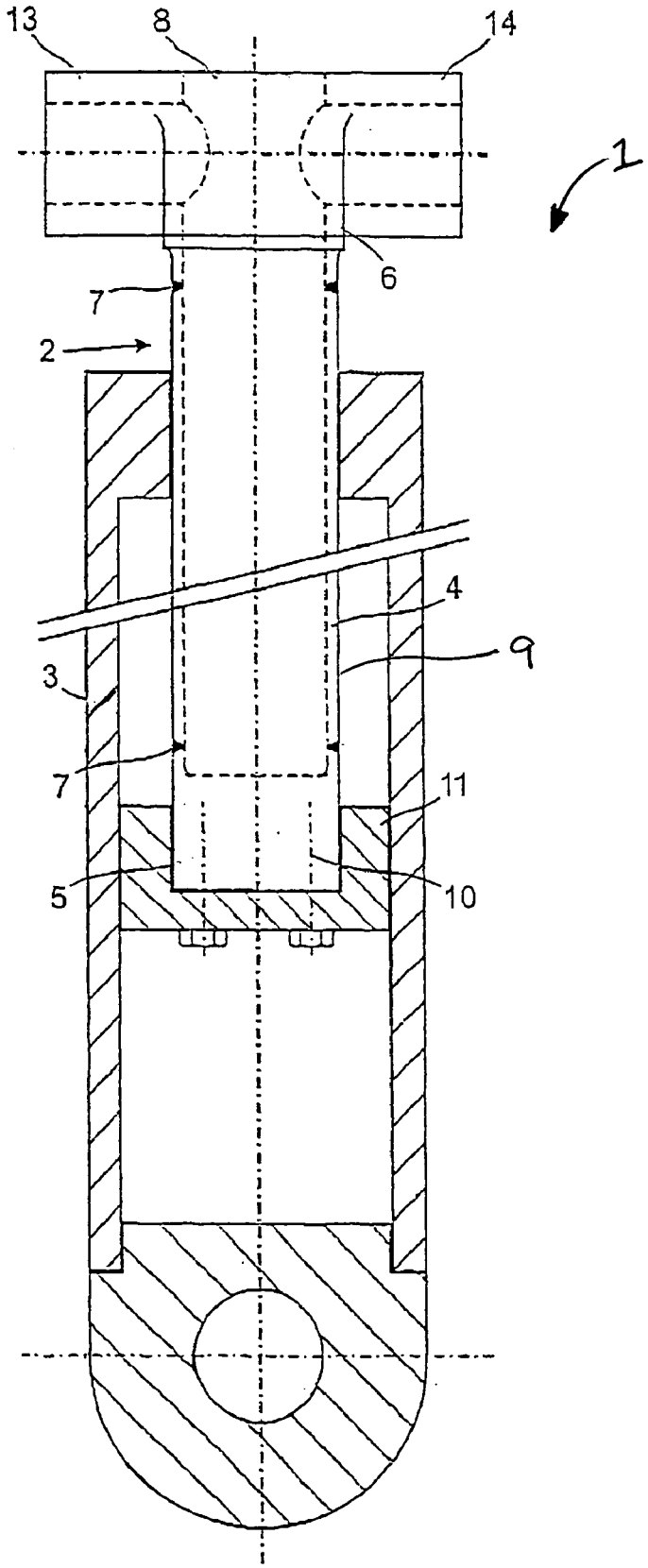
FIG. 1 shows a cross section through a hydraulic differential cylinder suitable for moving an extension arm or a carrier arm.

FIG. 1 shows a cross section through an embodiment of a hydraulic differential cylinder 1 in accordance with the invention.

The hydraulic cylinder 1 consists of the cylinder tube 3 and the piston rod 2, which is displaceably arranged within the cylinder tube 3 and is designed as a hollow piston rod. The hollow piston rod 2 comprises a tubular segment 4 that at its ends is provided with the end piece 5 of the side of the piston and the end piece 6 on the other side, the piston 11 being attached to the end piece 5 on the piston side by means of screw connections 10. The opposite end piece may be either welded on or attached in some other way, possibly by means of a thread or screw. However, the opposite end piece may also be designed as a single piece with the tubular segment. It is also within the scope of the invention for both ends of the piston rod to be welded to appropriate end pieces.

The end piece 6 on the pin-jointed end of the piston rod is provided with two laterally cantilevered tubular stubs 13, 14 for connecting the piston rod to a column arm or similar and an opening 8 by means of which it is possible to access the hollow within the piston rod 2 from outside. The cross section of the piston rod wall 9 remains uniformly smooth and plane over the entire region of the tubular segment 4, and even the transition to the end pieces 5, 6 is shaped in such a manner as to avoid any stress concentration effects. In particular, the transition from the tubular segment 4 to the piston-side end piece 5, which here consists of solid material, is provided with a sufficiently large radius of curvature to assure that no inadmissible stress concentration effects will occur.

Figure 2:
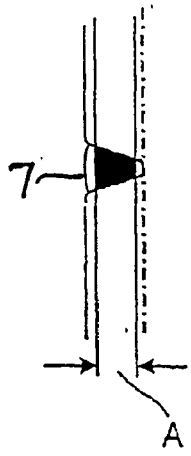
FIG. 2 shows a detail of the welded joint of FIG. 1, again as a cross section.

The hollow piston rod 2 is fabricated from end pieces 5 and 6 and tubular segment 4 by means of welded joints 7. The welded joints 7, which in the illustrated embodiment assume the form of V-joints. The V-joints are preferably shaped by means of a material-removing finishing processing in such a manner as to obtain a smooth, plane, and also flush transition at the joint between the parts to be joined. In this way, one avoids the possibility of projecting parts of the welded joint, as illustrated in FIG. 2, contributing to the production of stress concentration effect. The letter A in FIG. 2 designates the stress-concentration-free remainder of the welded joint after the finishing processing so that the outer surfaces in the region of the joint remain flush with the adjacent tube surfaces.

Figure 3:
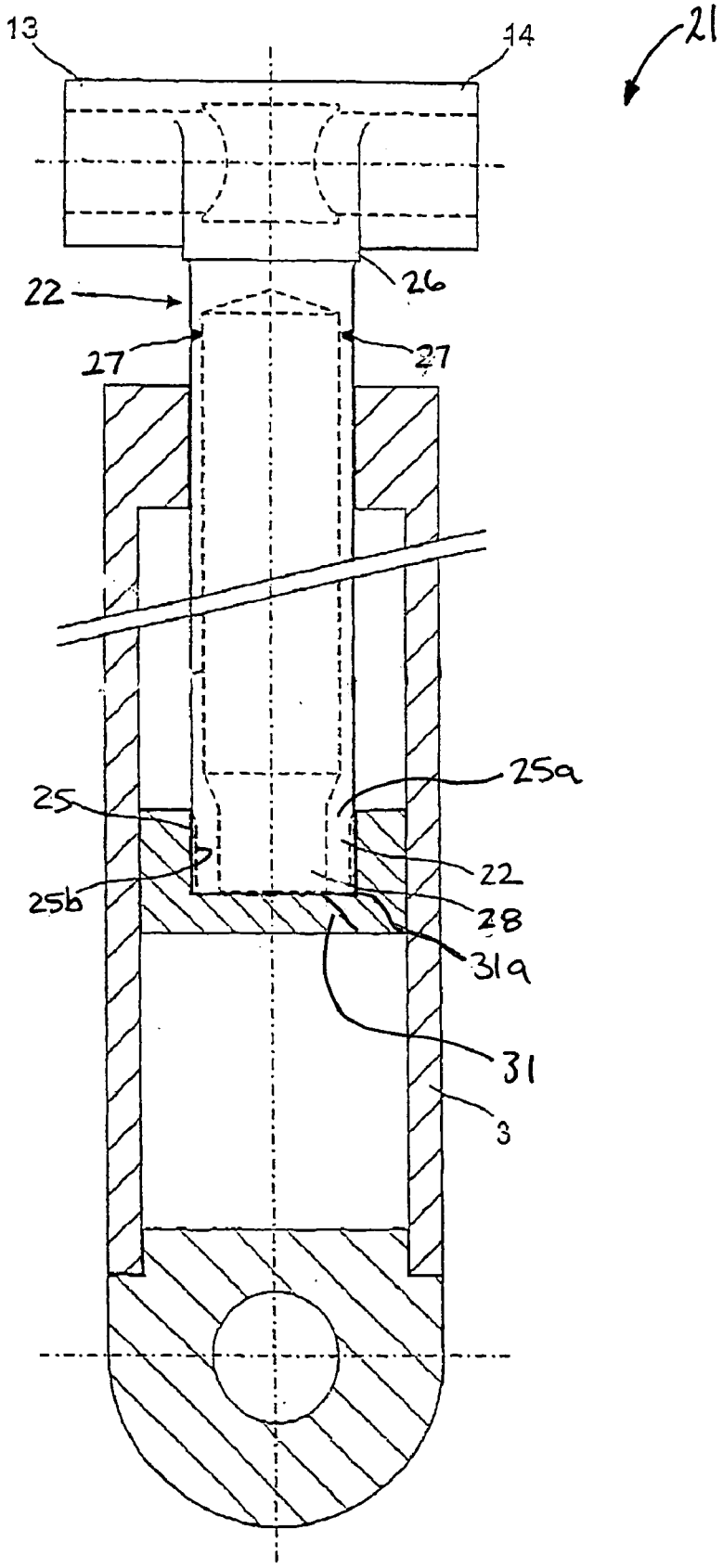
FIG. 3 shows the cross section of another embodiment of such a hydraulic differential cylinder.

Over and above this, FIG. 3 shows a second embodiment 21 of a hydraulic cylinder in accordance with the invention, in which the hollow piston rod 22 is provided with a welded-on end piece 26, the welded joint being indicated by the reference numeral 27. As far as the remainder of the hollow piston rod 22 is concerned, it may be made of solid material and therefore as a single piece incorporating the end piece 25, which in the illustrated embodiment is provided with a thickened wall. The area of the thickening is indicated by 25*a*. The reference numeral 25*b* indicates a thread applied to the outer jacket surface of the end piece 25. A corresponding thread 31*a* is provided on the piston 31, which can therefore be screwed onto the end piece 25. The opening for tool access, which is indicated by 28, makes it possible to gain access to the cavity within hollow piston rod 22.

Figure 4:
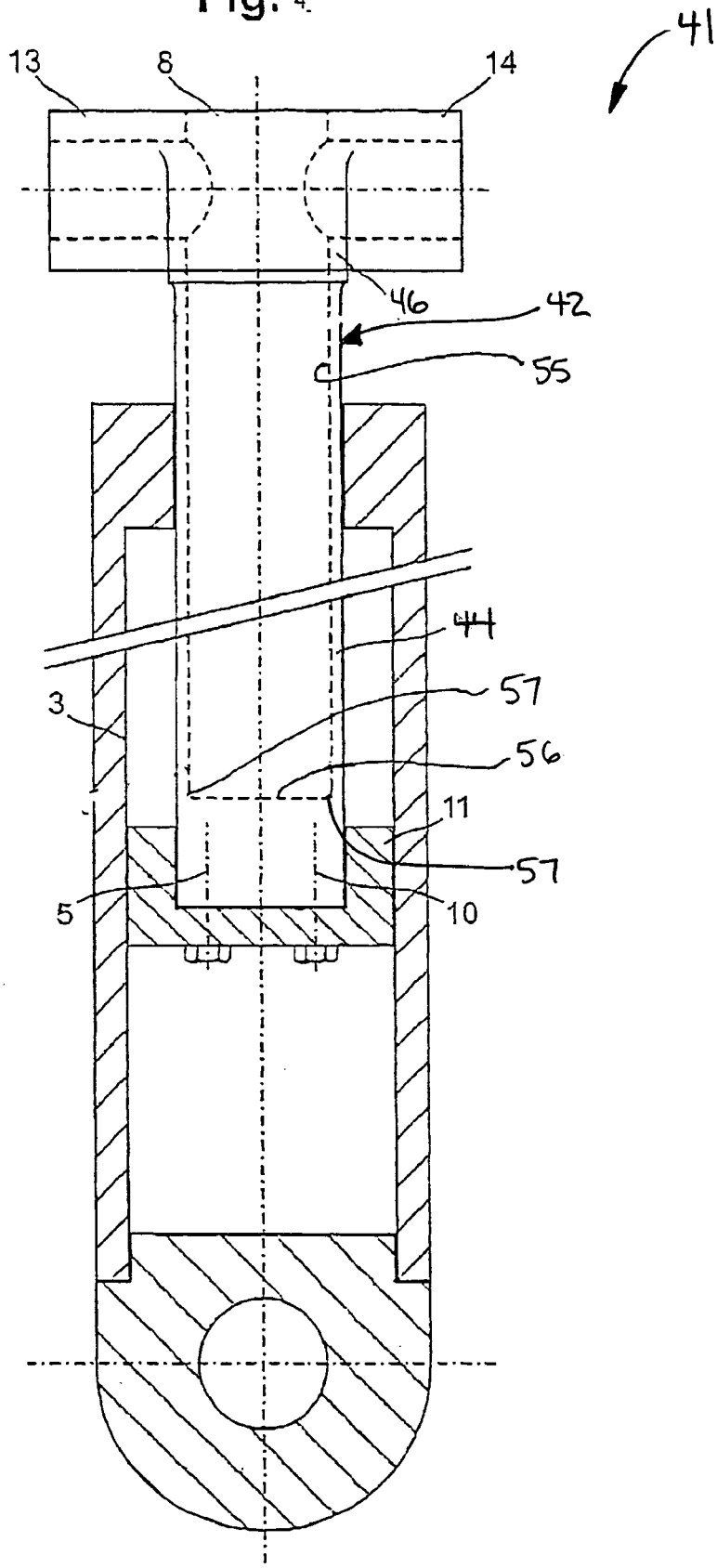
FIGS. 4 and 5 show cross sections with piston rods designed as a single piece.
Figure 5:
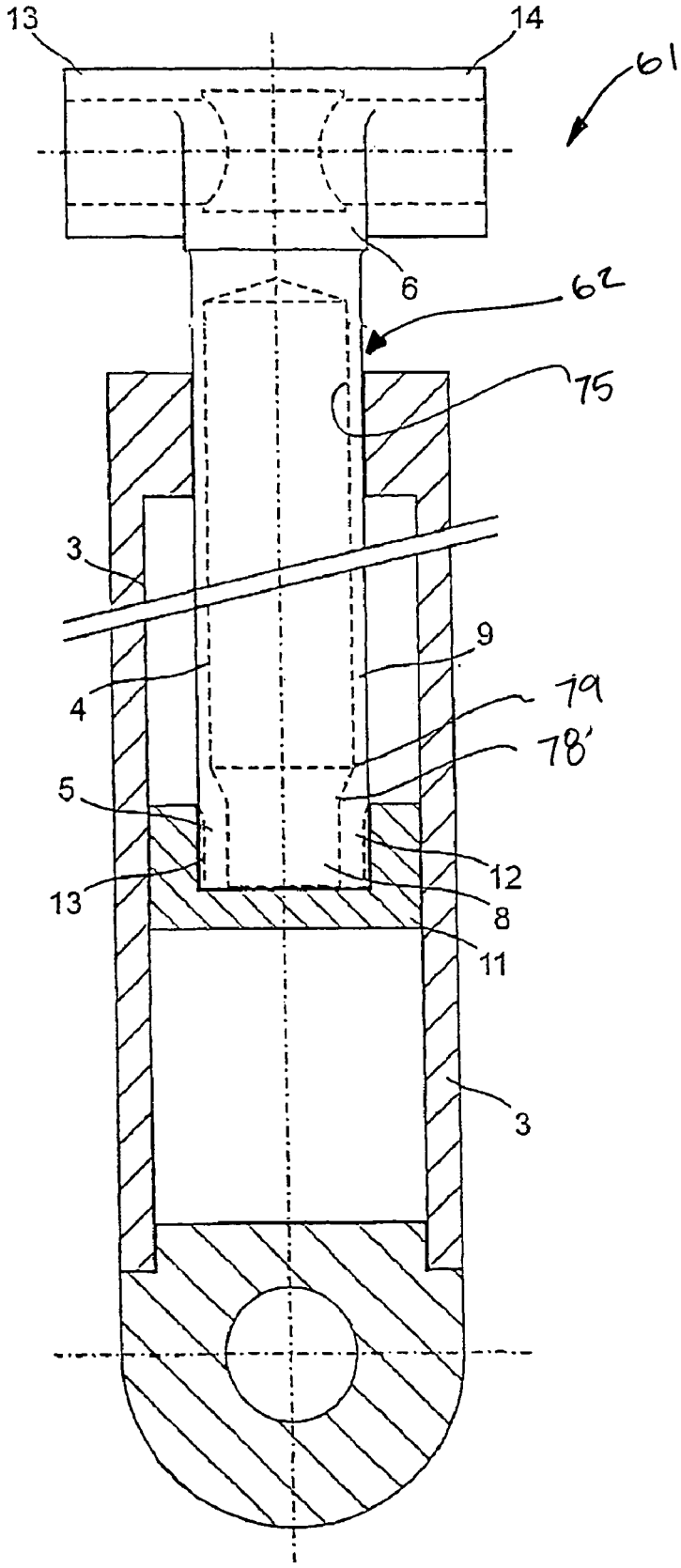

FIGS. 4 and 5 show third and fourth (41, 61 respectively) embodiments of a hydraulic differential cylinder in which hollow piston rods 42 and 62 are fabricated from a single piece of material, preferably a cast blank which in the embodiment illustrated by FIG. 4 is machined from the upper end in order to form the hollow within it. In the third embodiment, the internal wall 55 of end piece 45 at the pin-jointed end and tubular segment 44 is smoothed by means of material-removing machinery in order to avoid the creation of stress concentration effects. The transition to the front face at the end of the hollow space 56 assumes the form of radius's 57 that avoid stress concentration effects.

The same remarks apply with regard to the fourth embodiment illustrated by FIG. 5, with the sole difference being that, in this case, the material-removing processing is effected from the other side, that is to say, from the bottom end of the piston rod as shown in FIG. 5. Again, radius's 78 and 79 are provided in the transition region to avoid stress concentration effects. The internal wall 75 is once again smoothed by means of material-removing machinery in order to avoid the creation of stress concentration effects.

When the piston rod is a single piece, it is produced from a cast blank by means of subsequent material-removing machining from one end of the piston rod to form the hollow within it. For example, a material having a tensile strength of more than 700 N/mm$^2$ may be used so that the piston rod made therefrom will be capable of being very heavily loaded.

It is advantageous in the dimensioning of this hydraulic cylinder, which has to move the mass of a concrete spreader column which lies above it, if stress concentrations in the hydraulic differential cylinders can be reduced to a minimum. As, when the design has to take into account these concentrations, this has the general effect of increasing the thickness of the walls of the hydraulic differential cylinders. This increase in thickness goes hand in hand with a corresponding weight increase. However, if one reduces the stress concentrations that can occur during operation, it becomes possible to design the wall of the hydraulic differential cylinders with appropriately smaller thicknesses. This can lead to considerable weight advantages, especially when one bears in mind that it is very often necessary to use hydraulic differential cylinders with stroke lengths of 2.5 meters and over.

In accordance with the invention, this reduction in weight can be obtained by subjecting the regions of the welded joints, especially on the inside of the tubular segment, to finishing processing in the form of material-removing machining and smoothing.

It is essential for the purposes of the preferred embodiment of the invention, specifically in connection with the case where the piston rod is constituted by a single piece, that the length of the tubular segment, the transitions between the segment, and the end pieces should remain even, as far as a wall thickness is concerned. Additionally, in the case of changes in the cross section from the tubular segment to the end pieces, there may be provided a radius of curvature in order to avoid stress concentration effects at that surface, and the surface, as a whole, should be smooth. This makes sure that the stress concentration effects will be substantially avoided. The stress concentration factor is thus appropriately minimized and/or eliminated, so that it becomes possible to reduce the wall thickness of the tube by this factor and obtain a corresponding weight minimization and/or weight reduction. This weight minimization of the hydraulic differential cylinders naturally also has effects on the other components of the structure.

If the interior surface of the hollow piston rod is to be machined and/or smoothed with a view to reducing these loads associated with stress concentrations, or when producing the interior space of the piston rod from a previously produced solid casting, it will be advantageous to provide at least one of end pieces of the hollow piston rod with an opening by which a machining tool can gain access to the interior cavity of the piston rod. The opening being necessary for machining tool guidance purposes. Further, it is advantageous to provide this opening at the pin-jointed end of the hollow piston rod because this has constructional advantages as compared with an opening situated at the end on the piston side. This is particularly true when the piston is attached to the closed end of the piston rod on the piston side by prestressing the screws or by means of a threaded joint.

The lighter the extension arm, the greater will be its useful reach in both the horizontal and the vertical directions. Although the requirement of a light construction applies basically to all the components of the structure, it applies particularly and above all to the hydraulic cylinder.

A particularly simple method of obtaining material continuity across a joint is represented by welding, especially front-face welding of the end pieces to the tubular segment. However, in order to reduce stress concentration, a smooth surface or finish must be achieved in the region of the welded joint, where smooth means smooth with regard to the surface and plane with regard to the cross section of the wall.

It will be advantageous, especially at least in these regions. Therefore, the interior and/or exterior wall of the hollow piston rod must be subjected to a material-removing process, especially material-removing machining, where care has to be taken to ensure that this processing will not only eliminate abrupt changes in wall thickness, but also to remove the welding seams to such an extent as to eliminate the root of the welded seam. This is because welding seams will produce stress concentrations even when, notwithstanding the complete absence of abrupt changes in wall thickness, the root of the welding seam is still present.

In the manner described hereinabove it is possible
by smoothing the surface,
avoiding abrupt changes in wall thickness and
eliminating the roots of the welding seams to avoid stress concentrations and therefore to design the components of the hydraulic differential cylinder with a smaller weight, while yet obtaining the same stability.

In the case of single-piece hollow piston rod in which the hollow within the piston rod is produced by subjecting a solid blank to material-removing machining, it will be advantageous to produce the blank by means of known shaping processes. For example forging, casting, rolling or similar due to its simple fabrication.

The foregoing are preferred embodiments of the invention and changes and variations can be made without departing from the spirit and broader aspects of the invention, as defined in the appended claims, which are to be interpreted in accordance with the principles of patent law, including the Doctrine of Equivalents.

The invention claimed is:

1. A device with at least one extension arm or support arm for multi-linked extension arms, concrete spreader columns, lifting platforms, manipulators and the like, comprising: at least one hydraulic differential cylinder for operating the arm that is articulated on one side and can be raised, lowered and/or telescoped by means of the hydraulic differential cylinder; wherein the hydraulic differential cylinder is provided with a hollow piston rod further comprising a tubular segment and two end pieces arranged at the ends of this segment and designed as a single piece; wherein, with a view to avoiding stress concentrations, the cross section of the wall of the tubular segment over the entire length of the tubular segment, and the transitions from the tubular segment to the end pieces is made to be substantially smooth and plane; wherein, given jointing that establishes material continuity across the joint, at least one of the end pieces is welded to the segment creating a welded joint; wherein the welded joint is made to be substantially flush with the segment and the end piece joined to it by the welded joint by means of finishing in the form of material-removing processing, especially material-removing machining; wherein further the root of the welded joint is eliminated by the finishing, and the region of the welded joint, especially on the internal face of the tubular segment is smoothed, and at least one of the end pieces is provided with an opening through which a cutting tool can be introduced into in order to gain access to a space within the hollow piston rod for performing the said finishing therein.

2. A device in accordance with claim 1, wherein, with a view to avoiding stress concentrations, the cross section of the wall of the tubular segment over the entire length of the tubular segment and the transitions from the tubular segment to the end pieces are made to be substantially smooth and plane or with a radius of curvature that has practically no adverse effects on the strength.

3. A device in accordance with claim 1, wherein at least one of the internal or the external wall of the hollow piston rod is processed and smoothed by means of material-removing processing, especially material-removing machining in order to minimize stress concentrations.

4. A device in accordance with claim 1, characterized in that at least one joint between the tubular segment and the end pieces is a welded joint.

5. A device according to claims 4, wherein the welded joint is a welded joint on the front face.

6. A device in accordance with claim 1, characterized in that at least one joint between the tubular segment and the end pieces is constituted by a thread; wherein the wall thickness of the tubular segment is increased in its terminal part.

7. A device according to claim 6, wherein the joint between the tubular segment is constituted by a screw connection.

8. A method for the production of a hydraulic differential cylinder in accordance with claim 1, comprising: forming a blank with a tubular segment; arranging at least one end piece at one end of this segment, wherein the internal face of this blank is rendered accessible for a cutting tool by means of an opening provided in at least one of the end pieces; smoothing at least the region of the welded joint between the end piece, the tubular segment, and inside the tubular segment, by means of material-removing machining process.

9. A method in accordance with claim 8, wherein by means of any desired material-shaping process; forming a blank with a rod-like segment and two end pieces provided at the ends of this segment; forming by means of material-removing processing, especially material-removing machining, an opening in at least one of the end pieces and a hollow space within the rod-like element to produce a hollow piston rod.

10. A multi-linked, mast-like support arm for concrete spreader columns or the like, wherein the support arm is provided with one or more hydraulic differential cylinders in accordance with claim 1.

11. A device with at least one extension arm or support arm for multi-linked extension arms, concrete spreader columns, lifting platforms, manipulators and the like, comprising: at least one hydraulic differential cylinder for operating the arm that is articulated on one side and can be raised, lowered and/or telescoped by means of the hydraulic differential cylinder; wherein the hydraulic differential cylinder is provided with a hollow piston rod further comprising a tubular segment and two end pieces arranged at the ends of this segment or joined to each other in such a way as to obtain material continuity across the joint; wherein, with a view to avoiding stress concentrations, the cross section of the wall of the tubular segment over the entire length of the tubular segment, and the transitions from the tubular segment to the end pieces is made to be substantially smooth and plane; wherein, given jointing that establishes material continuity across the joint, at least one of the end pieces is welded to the segment creating a welded joint; wherein the welded joint is made to be substantially flush with the segment and the end piece joined to it by the welded joint by means of finishing in the form of material-removing processing, especially material-removing machining; wherein further the root of the welded joint is eliminated by the finishing, and the region of the welded joint, especially on the internal face of the tubular segment is smoothed, and at least one of the end pieces is provided with an opening through which a cutting tool can be introduced into in order to gain access to a space within the hollow piston rod for performing the said finishing therein.

12. A device according with claim 11, wherein the transitions from the tubular segment to the end pieces is made with a radius of curvature that has practically no adverse effects on the strength.

13. A device according with claim 11, wherein the end piece at the pin-jointed end of the piston rod is provided with the opening.

* * * * *

UNITED STATES PATENT AND TRADEMARK OFFICE

CERTIFICATE OF CORRECTION

PATENT NO. : 7,007,590 B2
APPLICATION NO. : 10/451563
DATED : March 7, 2006
INVENTOR(S) : Siegfried Trümper et al.

It is certified that error appears in the above-identified patent and that said Letters Patent is hereby corrected as shown below:

Column 2:
Line 32, "drawing" should be - -drawings- -.

Column 6:
Claim 5, line 9, "claims" should be - -claim- -.

Signed and Sealed this

First Day of August, 2006

JON W. DUDAS
*Director of the United States Patent and Trademark Office*